United States Patent [19]

Shmulovich

[11] Patent Number: 4,626,739

[45] Date of Patent: Dec. 2, 1986

[54] ELECTRON BEAM PUMPED MOSAIC ARRAY OF LIGHT EMITTERS

[75] Inventor: Joseph Shmulovich, New Providence, N.J.

[73] Assignee: AT&T Bell Laboratories, Murray Hill, N.J.

[21] Appl. No.: 609,000

[22] Filed: May 10, 1984

[51] Int. Cl.[4] ..... H01J 29/10

[52] U.S. Cl. ..... 313/469; 313/461

[58] Field of Search ..... 313/466, 467, 468, 469, 313/470, 472, 474, 476, 461, 495, 496

[56] References Cited

U.S. PATENT DOCUMENTS

| | | | |
|---|---|---|---|
| 2,533,809 | 12/1950 | Hushley et al. | 313/466 |
| 2,616,817 | 11/1952 | Klasens et al. | 117/33.5 |
| 2,665,220 | 1/1954 | De Gier | 313/466 |
| 2,996,634 | 8/1961 | Woodcock | 313/470 |
| 3,041,456 | 6/1962 | MacLeod | 313/469 |
| 3,392,297 | 7/1968 | Schwartz | 313/466 |
| 3,858,081 | 12/1974 | Rehkopf et al. | 313/467 |
| 4,140,941 | 2/1979 | Uemura | 313/495 |
| 4,274,110 | 6/1981 | Lehnert | 358/60 |

FOREIGN PATENT DOCUMENTS

| | | | |
|---|---|---|---|
| 0013767 | 2/1979 | Japan | 313/466 |
| 0014665 | 2/1979 | Japan | 313/470 |
| 0122344 | 9/1980 | Japan | 313/466 |
| 0346628 | 7/1960 | Switzerland | 313/461 |
| 2000173A | 8/1967 | United Kingdom . | |
| 0716085 | 2/1980 | U.S.S.R. | 313/461 |

OTHER PUBLICATIONS

"Geometrical Properties of Random Particles and the Extraction of Photons from Electroluminescent Diodes", *Journal of Applied Physics*, vol. 45, No. 5, 1974, pp. 2229–2253, W. B. Joyce et al.

"Photometric Figures of Merit for Semiconductor Luminescent Sources Operating in Spontaneous Mode", *Infrared Physics*, vol. 6, 1966, pp. 1–19, Pergamon Press Ltd., W. N. Carr.

"Coupling of Spherical-Surfaced LED and Spherical--Ended Fiber", *Journal of Applied Physics*, vol. 51, No. 1, Jan. 1980, pp. 30–36, O. Hasegawa et al.

*Primary Examiner*—David K. Moore

*Attorney, Agent, or Firm*—Michael J. Urbano

[57] ABSTRACT

In a CRT system the luminescent screen includes an ordered array of rows and columns of phosphor elements, illustratively made of single crystal material. Each element is surrounded on all sides (except the light output face) by reflective material. To enhance light extraction efficiency, the output face may be textured. An electron beam is made incident on the output face of selected ones of the elements and scans in two dimensions across the plane of the elements. Also described is an arrangement whereby the electron beam is made incident on the back surface of the elements opposite the output face.

8 Claims, 3 Drawing Figures

ELECTRON BEAM PUMPED MOSAIC ARRAY OF LIGHT EMITTERS

BACKGROUND OF THE INVENTION

This invention relates to cathode ray tubes and, more particularly, to luminescent screens for use in such tubes.

The most common cathode ray tubes (CRTs) utilize a powdered phosphor on a carrier as a luminescent screen. These screens have relatively low thermal loadability since heat is insufficiently dissipated from the phosphor grains. As a consequence, during high brightness operation the phosphor has low quantum efficiency and may even be severely damaged. In addition, powdered phosphors exhibit coulombic degradation; that is, quantum efficiency declines due to electron bombardment. This problem is particularly acute in high brightness applications when high electron beam current is used (e.g., in projection CRT applications).

A partial solution to this problem is described in British patent application G.B. No. 2,000,173A which proposes that the luminescent screen be fabricated from a self-supporting monocrystalline body which includes a luminescent layer containing at least one activator. This screen purports to reduce diffuse reflections and increase heat dissipation, thus improving resolution and thermal loadability. Garnet crystal structures with Tb, Tm, Eu, Ce or Nd activators are said to be preferred.

The single crystal nature of the screen, however, gives rise to light trapping inside the monocrystalline layer which has a relatively high refractive index relative to its surroundings. This trapping phenomenon reduces the brightness which would otherwise be obtainable from the screen. However, the brightness obtainable from any luminescent screen, whether a single crystal or powdered material is used, is limited by power saturation of the phosphor; that is, beyond the saturation point, additional increases in electron beam power density do not yield significantly increased brightness. In addition, in certain cases the practical limit to achievable brightness is caused by heating of the phosphor, or by the inability to focus a high current electron beam to the desired spot size. In many applications (e.g., projection CRT.), that practically achievable brightness level is insufficient.

In my copending application Ser. No. 555,167 filed on Nov. 25, 1983 (abandoned in favor of continuation-in-part application Ser. No. 749,928 filed on June 28, 1985), however, light trapping within a phosphor layer is exploited advantageously in a luminescent screen with enhanced brightness. In accordance with one embodiment described in that application, the luminescent screen of a cathode ray tube includes a monoscrystalline or amorphous phosphor layer shaped into an array of elongated, essentially parallel, rod-like elements each having at one end an output face from which light escapes and a reflective coating which covers other surfaces of the element. An electron beam with an oblong cross-section is made incident along the elongated dimension of selected ones of the elements. In this scheme, the resolution is determined by the cross-sectional dimensions of each rod-like element and is not limited by the power of the electron beam or by photon scattering effects. Importantly, for a given pixel (i.e., output face of an element) much higher electron beam power can be deposited into an element without experiencing the adverse effects of power saturation, thermal loading, and beam focusing. Hence, much higher brightness for a given resolution can be attained.

However, scanning the array of rods with the e-beam causes the light spot to scan in only one dimension. To effect two dimensional scanning, the light spot has to be coupled to some form of optical deflection apparatus (e.g., rotating mirrors). Such apparatus is suitable for many applications (e.g., nonimpact printers, projection CRT), but, nevertheless, utilizes mechanical apparatus to scan in one of the dimensions. Electronic scanning in both dimensions would be simpler and more reliable.

SUMMARY OF THE INVENTION

The advantageous properties of single crystal phosphors (absence of coulombic degradation and high thermal loading levels) and the ability to scan rapidly in two dimensions are combined in a CRT in accordance with my invention: an ordered array of rows and columns of light emitting elements of phoshor material is embedded in a substrate. Each element is surrounded on all sides (except the light output face) by reflective material. An electron beam is made incident on the output face of selected ones of the elements and scans in two dimensions across the plane of the elements. Consequently, a light spot, which also scans in two dimensions, emanates from the output faces as the electron beam moves. Alternatively, the substrate may be thinned so that the electron beam may be made incident on the back surface of the elements opposite the output face.

BRIEF DESCRIPTION OF THE DRAWINGS

My invention, together with its various features and advantages, can be readily understood from following more detailed description taken in conjunction with the accompanying drawing, in which.

DETAILED DESCRIPTION

Figure 1:
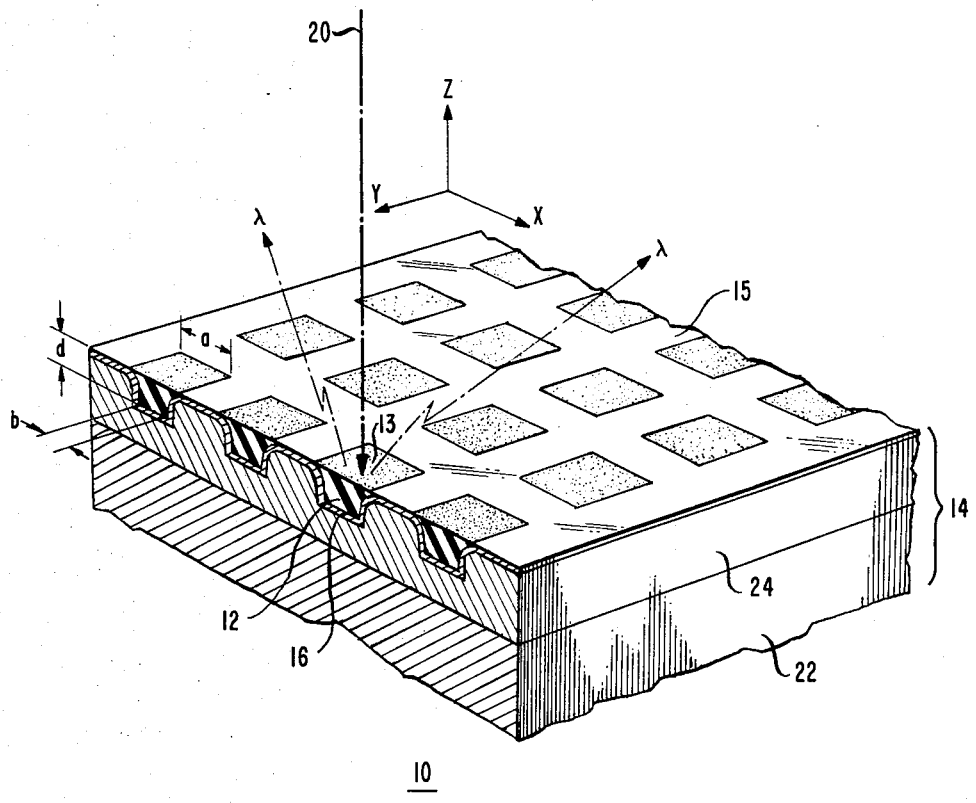
FIG. 1 is a schematic isometric view of a luminescent screen for use in a CRT in accordance with one embodiment of my invention.

With reference now to FIG. 1, there is shown schematically, and in partial cross section, a luminescent screen 10 which includes an ordered array of rows and columns of phosphor elements 12 embedded in a substrate 14. The elements illustratively have the shape of mesas or truncated pyramids, but other geometric shapes are also suitable. Each element 12 is surrounded on all sides, except its output face 13, by reflective material illustratively depicted as a reflective layer 16. The output faces of the elements are located on a common surface 15 of the screen. In a preferred embodiment the output faces are textured in order to enhance the coupling of light out of the elements; that is, the output faces are light scattering surfaces.

The light, depicted as rays λ, is generated by an electron beam 20 which is made incident upon selected ones of the elements 12 in accordance with the image or information to be displayed. The electron beam is absorbed in the phosphor material of an element 12 which may be a single crystal material (e.g., a garnet doped with a suitable activator) or an amorphous material (e.g., an alkaline earth aluminosilicate). In general, the phosphor material is transparent; i.e., it exhibits low light scattering and low absorption at the wavelength of the emitted light.

The electron beam 20 is directed generally along the z-axis, although it need not be precisely or even nearly perpendicular to the surface of the target (as is evident from FIG. 2 to be discussed later). As the electron beam is scanned in the x-y plane across the surface of the target, a scanning spot of light emanates therefrom. The scanning spot of light may be coupled by suitable optics to an observer station or display screen, for example.

Returning now to FIG. 1, the substrate 14 is shown to be a composite structure including a heat sink 22 and a binding layer 24. In one embodiment layer 24 serves to fill the gaps between the individual elements 12 and to mount them in good thermally conductive relationship to the heat sink 22. The elements 12 are shown embedded in binding layer 24, but depending upon the materials used, it might be possible for the heat sink 22 and the binding layer 24 to be a single component. In general, the heat sink material should exhibit good adhesion to the material it contacts (e.g., the binding layer, the reflective layer, or the phosphor material). Moreover, the thermal expansion coefficient of the heat sink material should be close to that of the phosphor material. In addition, in some cases the reflective layer 16 may be omitted depending upon the reflectivity of the material of the heat sink.

In order to prevent charge build-up (i.e., to define the potential of the elements) the elements are overlayed with a transparent conducting layer (e.g., indium tin oxide) which is connected to a reference potential (e.g., the anode voltage). The conducting layer should be thin enough so that it does not significantly attenuate the electron beam. For simplicity, this layer is not shown in FIG. 1.

In the case where the elements 12 comprise single crystal YAG, they are doped with a suitable activator depending upon the wavelength (color) of the light desired (e.g., Ce, Tm or Eu for light emission at green, blue or red wavelengths, respectively). For YAG a suitable reflective layer 16 comprises a layer of A1 or a composite layer of $SiO_2$ in contact with the YAG element (for total internal reflection) and a layer of Al on the $SiO_2$. A suitable binder layer 24 comprises an Al-Si or Au-Si eutectic, and a suitable heat sink 22 comprises metallized $Al_2O_3$ or BeO, or other thermally conductive materials such as Cu or Al. However, in order to bind the reflective layer to the binding layer, it may be necessary to coat the reflective layer with a buffer layer (e.g., a Cr-Au layer in the case of an Al reflective layer).

In order to enhance the light extraction efficiency of each element the output surface 13 is provided with a scattering texture as shown by the stippling in FIG. 1. Alternatively, the output surface could be shaped to form a dome-like lens (not shown). A particular design would be chosen to satisfy the optical coupling parameters of the CRT, e.g., the f-number of the optics utilized. Light generated within each element is confined to that element and can be emitted only from its output face. Consequently, the problem of light trapping in uniform single crystal prior art screens (i.e., light propagation to the edges of the screen) is eliminated and the efficiency of light extraction is increased. For example, assuming a Lambertian scattering surface, an index of refraction of 1.84 of the crystal (e.g., garnet) and 98% reflectivity of reflective layer 16, then 20% of the generated light could be collected with an f-0.9 lens, as compared to 3.5% collected with a uniform single crystal screen. This collection efficiency was calculated assuming that the area of the output face 13 is one third of the total surface area of the element 12. See, W. B. Joyce et al, *Journal of Applied Physics*, Vol. 45, No. 5, p. 2229 (1974).

The resolution of the target 10 is limited by the size of the elements 12 and the spacing between them. On the other hand, the efficiency of the target 10, as compared to a uniform single crystal target, depends on the type of scanning utilized. For continuous scanning, the efficiency of the target 10 is decreased by the geometric duty factor (i.e., by the ratio of the total area of the output faces of the elements to the total area of the screen). However, the decrease in efficiency of target 10 can be eliminated by using beam-indexing (i.e., by turning off the beam in the nonluminescent areas between elements) at the expense of more complex electronics. In addition, in order to avoid wasting beam energy in nonphosphor material, the depth d of each element should be larger than the penetration depth of the electron beam in the phosphor material of the elements 12.

When the output surface of the elements is textured to enhance scattering, the shape of the elements is not critical except for the general considerations noted above (the area of output face 13 should preferably be a large fraction of the total surface area of the element 12). For example, the fact that the elements are depicted approximately as truncated pyramids is not critical. However, when the output face is not a scattering surface, for example when it is a polished spherical surface, the shape of the elements is important. To couple the light into a lens, the output cone of the emitted radiation should correspond to that of the optical components receiving the light. Thus, the light should be concentrated into a narrow solid angle. The geometrical shape of the element 12 can be designed using as a guide an extensive literature dealing wth coupling of light emitting diodes to optical fibers. See, for example, W. N. Carr, *Infrared Physics*, Vol. 6, pp. 1–19, Pergamon Press, 1966; or O. Hasegawa and R. Namazu in *Journal of Applied Physics*, Vol. 51, No. 1, p. 30 (1980).

Figure 2:
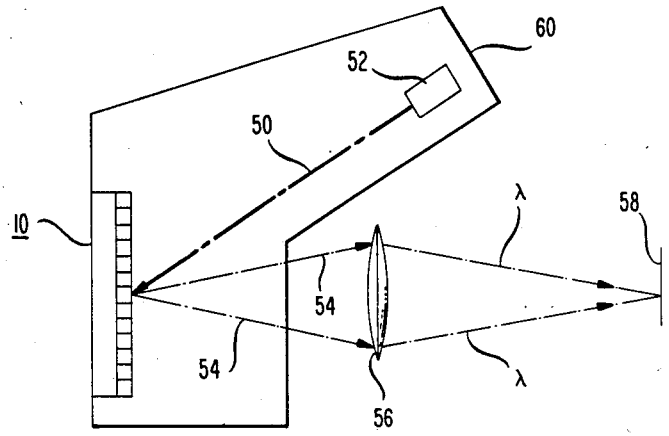
FIG. 2 is a schematic of a CRT in which refractive optics are utilized to couple light from a luminescent screen.

In one application of a projection system in accordance with my invention, as shown in FIG. 2, an off-axis electron beam 50 is used; i.e., electron beam 50 from gun 52 is directed at an oblique angle to the planar front face of luminescent screen 10. The light 54 generated by absorption of the electron beam 50 is collected by a lens system 56 and is focused on a viewing screen 58 or other utilization device not shown. Of course, the lens system 56 may be incorporated within the enclosure 60 of the CRT.

It is to be understood that the above-described arrangements are merely illustrative of the many possible specific embodiments which can be devised to represent application of the principles of the invention. Numerous and varied other arrangements can be devised in accordance with these principles by those skilled in the art without departing from the spirit and scope of the invention.

Figure 3:
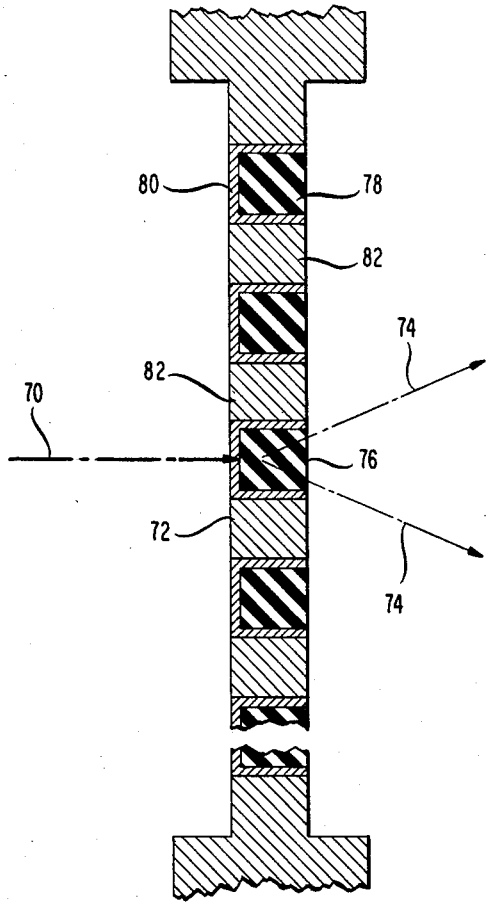
FIG. 3 is a schematic cross-sectional view of a luminescent screen in which the electron beam is incident on the back of the screen in accordance with another embodiment of my invention.

In particular, an alternative mode of operation utilizes an electron beam which is incident on the back surface of the luminescent screen; i.e., on the surface opposite to that from which the light emanates. Such a configuration is shown in FIG. 3 where the electron beam 70 is incident on the back surface 72 of the target, and the light 74 is emitted through the front surface 76. As before, each phosphor element 78 is bounded on all sides (except the output face) by a reflective layer 80, and each element 78 is embedded in a matrix of material 82 which serves both as a mechanical support and as a heat sink.

EXAMPLE

A luminescent screen 10 according to FIG. 1 was fabricated as follows. A 75 μm thick epitaxial layer of Ce:YAG was grown on a single crystal YAG substrate (not substrate 14). The epitaxial layer was then shaped (by cutting and etching) so as to define a mosaic array of rows and columns of YAG elements 12. The array was then coated with a 0.15 μm thick layer of Al which served as reflective layer 16. A binding layer 24 of conductive epoxy was then deposited on the Al layer so as to fill in the gaps between the elements. A sapphire heat sink 22 was then bonded to the epoxy layer. Thereafter, the YAG substrate was polished off to expose the output faces 13 of the elements 12.

The array measured about 0.5×0.5 inches and the center-to-center spacing of elements was about 6 mils. The elements had the general shape of truncated pyramids with the output face being a 5 mil square, the truncated surface being a 4 mil square, and the depth d being 1.5 mils. The area of the output face of each element was about 37% of the total surface area of each element.

With a 25 kV, 3 μA electron beam, which was raster scanned on a continuous basis, light extraction was enhanced by a factor of 2 as compared to a screen having a uniform YAG phosphor layer. A textured output face would have enhanced the light extraction efficiency even more.

This experiment, of course, was done to demonstrate feasibility. In practice, for a 2 inch target having 525×525 lines of resolution, illustrative elements might measure 3 mils square and be spaced 1 mil apart. The electron beam power loading might be more than 30 $W/cm^2$.

What is claimed is:

1. Optical apparatus comprising means for generating a scannable electron beam, and a luminescent screen including a transparent phosphor layer on which said electron beam is made incident to generate a scannable spot of light, Characterized in that said screen includes a substrate, said phosphor layer comprises an array of discrete elements partially embedded in said substrate which is thick enough to dissipate heat generated in said elements, each of said elements having an output face from which said light escapes, the area of each output face being a relatively large fraction of the total surface area of each element, a reflective coating covers all surfaces of each of said elements except said output face, and said generating means makes said electron beam incident on the output face of selected ones of said elements.

2. The apparatus of claim 1 wherein said elements comprise essentially truncated pyramids arranged in an ordered array of rows and columns.

3. The apparatus of claim 1 wherein said output face is textured to provide light scattering.

4. The apparatus of claim 1 wherein said output face is optically polished.

5. The apparatus of claim 1 wherein said substrate includes a heat sink and a binding layer adherent to said heat sink and into which said elements are partially embedded.

6. The apparatus of claim 1, 2, 3, 4 or 5 wherein said phosphor layer comprises a single crystal garnet doped with an activator.

7. The apparatus of claim 1, 2, 3, 4 or 5 wherein said phosphor layer comprises an amorphous material.

8. A display system comprising optical apparatus according to claim 1, 2, 3, 4 or 5 for generating a scannable spot of light, said screen facing said generating means and being oriented at an oblique angle to the direction of said electron beam, and lens means for focusing light emitted by said screen onto a utilization device.

* * * * *